United States Patent [19]

Laido

[11] 4,447,993

[45] May 15, 1984

[54] ALIGNMENT MEANS FOR CENTRIFUGAL BLASTING WHEEL

[76] Inventor: Donald A. Laido, N22 W28698 Louis Ave., Pewaukee, Wis. 53072

[21] Appl. No.: 369,125

[22] Filed: Apr. 16, 1982

[51] Int. Cl.[3] ..... B24C 5/06

[52] U.S. Cl. ..... 51/439; 51/434; 51/435

[58] Field of Search ..... 51/439, 434, 435, 438, 51/432, 431

[56] References Cited

U.S. PATENT DOCUMENTS

| | | | |
|---|---|---|---|
| 2,376,639 | 5/1945 | Unger . | |
| 2,819,562 | 1/1958 | Barnes . | |
| 2,983,082 | 5/1961 | Gossard . | |
| 3,151,417 | 10/1964 | Hartman et al. . | |
| 3,290,827 | 12/1966 | Bowling, Sr. et al. | 51/434 |
| 3,444,651 | 5/1969 | Geisseler | 51/434 |
| 3,654,736 | 4/1972 | De Groot | 51/9 |
| 3,683,556 | 8/1972 | Leliaret | 51/9 |
| 3,768,209 | 10/1973 | Punter et al. | 51/434 |
| 3,785,105 | 1/1974 | Freeman | 51/9 |
| 3,872,624 | 3/1975 | Ramaswaz | 51/9 |
| 4,164,104 | 8/1979 | Carpenter | 51/432 X |
| 4,176,502 | 12/1979 | Leliaret | 51/434 X |

FOREIGN PATENT DOCUMENTS 834340 7/1949 Fed. Rep. of Germany .

OTHER PUBLICATIONS

"RI Rotoblast Wheel", Bulletin 229A, published by Pangborn Division, The Carborundum Company.

*Primary Examiner*—E. R. Kazenske
*Assistant Examiner*—Willman Fridie, Jr.
*Attorney, Agent, or Firm*—Andrus, Sceales, Starke & Sawall

[57] ABSTRACT

A centrifugal blasting apparatus (11) is operable by a motor driven shaft (21) providing an annular ridge (33) to provide a fixed reference. An annular sleeve (34) is journalled upon the shaft (21) and sandwiched between the annular ridge (33) and a hub (40) which, in turn, is connected to and supports the particulate throwing wheel (50, 70) in precise axially spaced alignment. An axial thrust is applied against the hub (40) through an impeller (115) and centering plate (112) by a threaded bolt (117) secured to the shaft (21).

1 Claim, 9 Drawing Figures

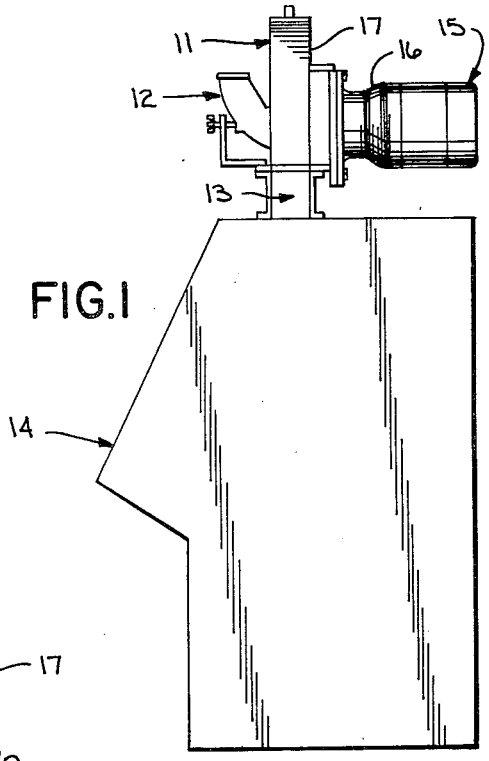
FIG.1
FIG.2
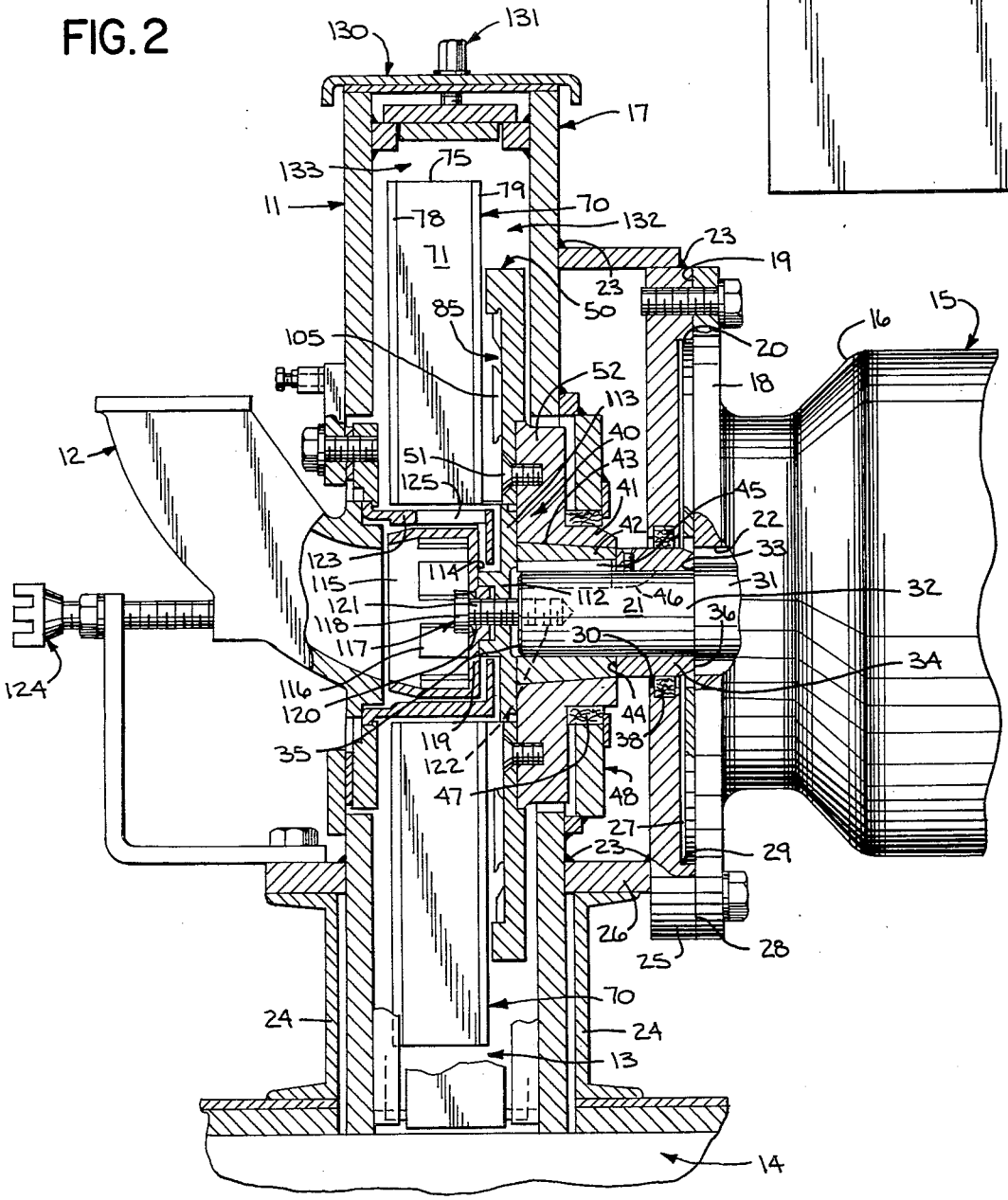

ALIGNMENT MEANS FOR CENTRIFUGAL BLASTING WHEEL

CROSS REFERENCE TO RELATED APPLICATIONS

A portion of the apparatus and methods disclosed in this application are claimed in the following concurrently filed applications:

Ser. No. 06/369,130 filed Apr. 16, 1982 in the name of Donald A. Laido and entitled "Motor Mount For Centrifugal Blasting Apparatus".

Ser. No. 06/369,129 filed Apr. 16, 1982 in the name of Donald A. Laido and entitled "Centrifugal Blasting Wheel, Blade And Interlock Therefore".

BACKGROUND OF THE INVENTION

This invention relates to the alignment of a hub connected to support and rotate a particulate throwing wheel within a centrifugal blasting apparatus.

Centrifugal blasting wheels have been used to project particulate material at high velocity against a part to be cleaned, deburred or otherwise treated. In other applications, centrifugal blasting wheels have been used in foundry operations to scrub sand by projecting used sand against an object to free foundry binder from the surface of the sand grains.

BRIEF SUMMARY OF THE INVENTION

This invention relates to a centrifugal blasting apparatus which is operable by a motor driven shaft connected to rotate a hub supporting a particulate throwing wheel.

A stop provides a fixed reference while means operatively connects the hub to the stop for maintaining the hub in precise axially spaced alignment to accurately position the hub and interconnected throwing wheel relative to the stop.

In one construction, an annular sleeve provides a first axial end which engages an annular abutment integrally formed in the motor output shaft while a second oppositely disposed axial end of the sleeve abuts the hub.

such alignment permits a number of rotatable members, i.e. particulate throwing wheel, hub, hollow vaned impeller, centering plate, etc. to be precisely axially aligned with reference to the input shaft to avoid interference with stationary parts, i.e. stationary control cage, blast wheel housing, etc.

The construction permits easy assembly wherein the hub and interconnected parts can be precisely located upon the shaft while avoiding unnecessary steps in centering the hub.

BRIEF DESCRIPTION OF THE DRAWINGS

FIG. 1 is a block diagramatic illustration of a centrifugal blasting apparatus for throwing particulate material;

FIG. 2 is a sectional view of a portion of the blasting apparatus of FIG. 1;

DESCRIPTION OF THE PREFERRED EMBODIMENT

Figure 3:
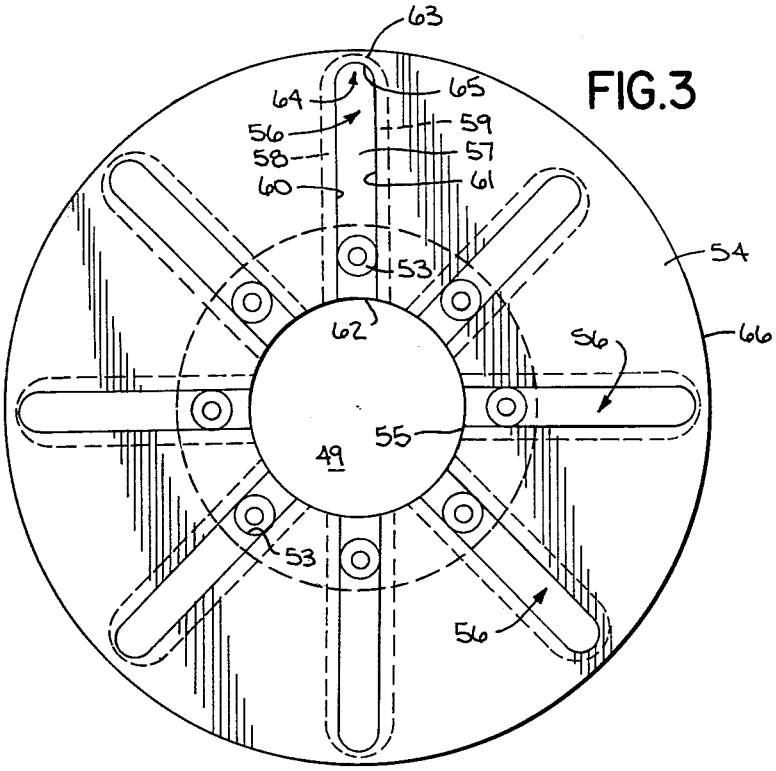
FIG. 3 is a side view of a plate for a throwing wheel used in the blasting apparatus of FIG. 1.
Figure 4:
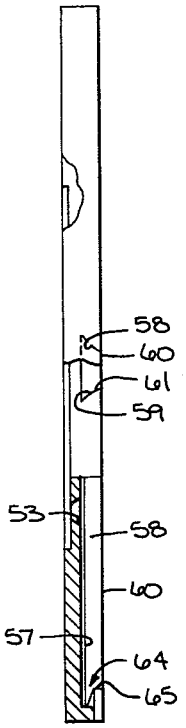
FIG. 4 is a side view of the plate of FIG. 3 partially sectioned along the lines 4—4.
Figure 5:
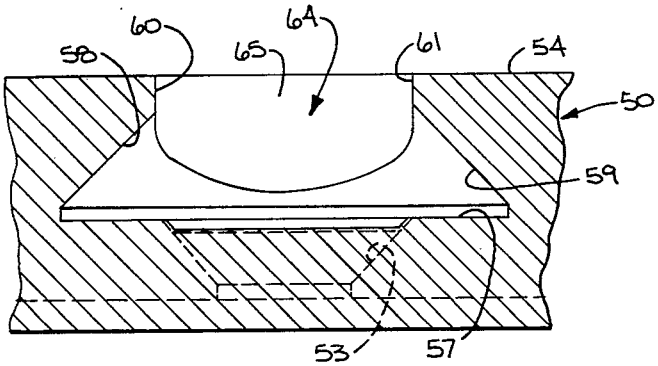
FIG. 5 is a partial radial view taken from the center of the plate of FIG. 3 and showing a dovetail groove and stop.
Figure 9:
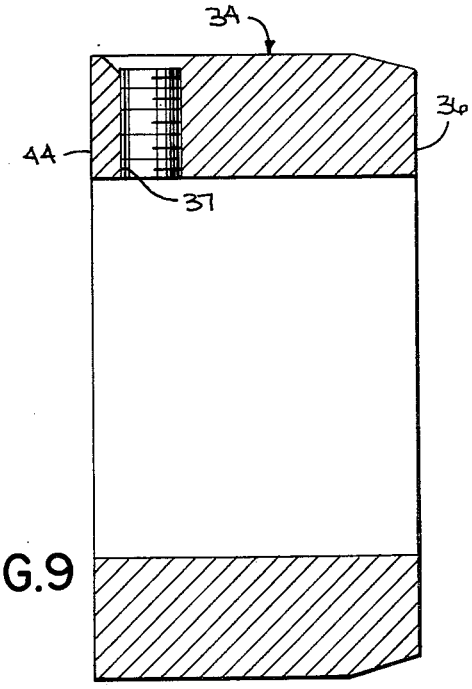
FIG. 9 is a sectional view of a sleeve used within the blasting apparatus of FIG. 1.
Figure 8:
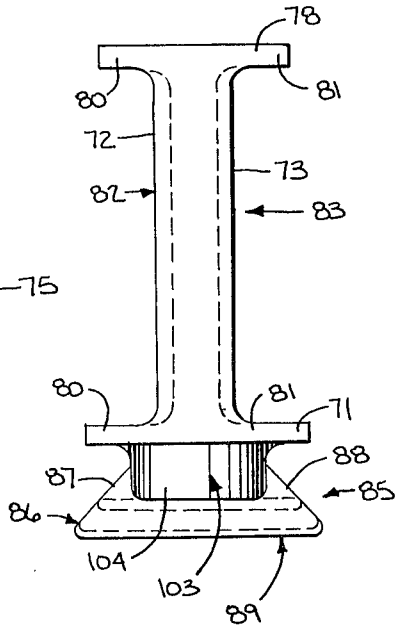
FIG. 8 is an end view of the blade of FIG. 6 without the pad.
Figure 6:
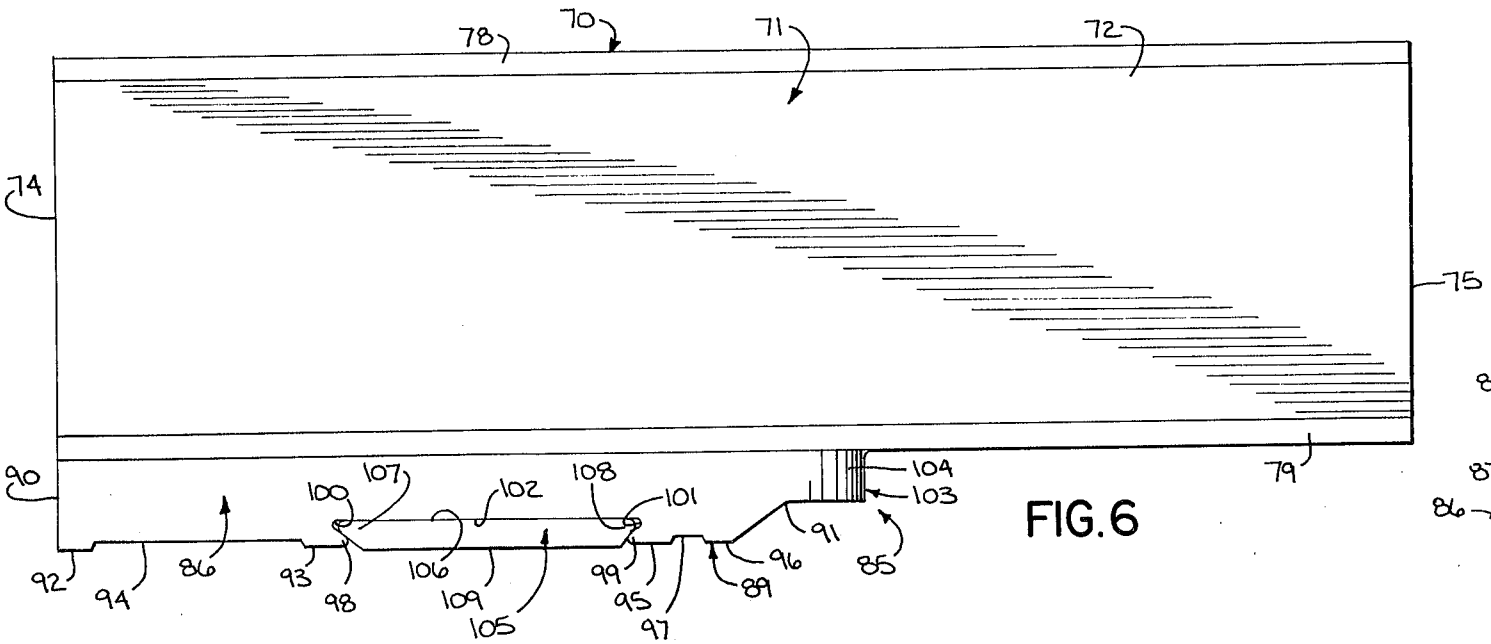
FIG. 6 is a front view of a blade and frictional pad for removable attachment to the plate of FIG. 3 for use in the blasting apparatus of FIG. 1.
Figure 7:
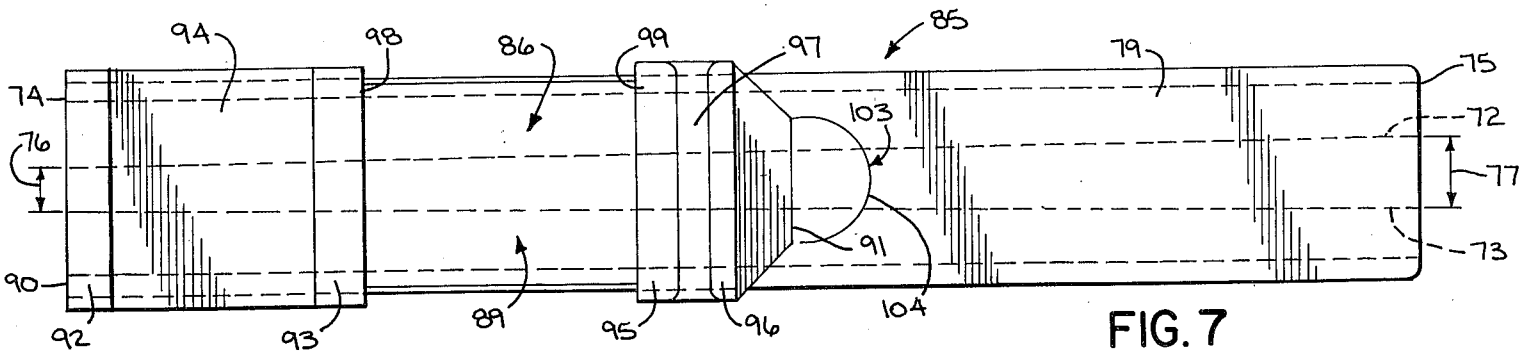
FIG. 7 is a side elevational view of the blade of FIG. 6 without the pad.

A centrifugal blasting apparatus 11 receives particulate material through a feed spout 12 and propels such particulate material at high velocity through an output port 13 to blast machine 14 wherein machine parts and the like may be cleaned, deburred, or otherwise treated.

A motor 15 includes a motor housing 16 which is directly attached to a blast wheel housing 17 for independent support of the motor 15.

The motor housing 16 includes a mounting plate 18 having an annular machined surface 19 surrounding an annular lip or abutment 20. A rotary output shaft 21 provided by motor 15 passes through an opening 22 within plate 18.

The blast wheel housing 17 includes a number of interconnected elements, some of which are secured through suitable welds 23. The blasting apparatus 11 is mounted to the blast machine 14 through a pair of spaced supporting members 24. An annular housing plate 25 is fixedly mounted to the support 24 through an intervening housing member 26 through bolts or studs (not shown). The housing member 25 provides a circular opening 30 surrounding the output shaft 21 of motor 15. The housing member 25 further includes a recess 27 surrounded by an annular machined surface 28 and an abutment 29.

During assembly, the annular lip 20 provided by the motor housing plate 18 is inserted into recess 27 to engage the annular abutment 29 while the machined surface 19 of the motor housing plate 18 abuts the machined surface 28 of the throwing wheel housing 17. In that surfaces 19 and 28 are machined, it is possible to accurately align the axis of rotor 21 with respect to the housing 17.

The shaft 21 of motor 15 includes a shaft portion 31 providing a larger diameter than a shaft portion 32 to define an annular abutment 33. During assembly, an annular sleeve 34 is passed over an end 35 of shaft 21 until a first axial sleeve end 36 abuts against the annular abutment 33 provided by shaft 21. When the sleeve is in place, a set screw (not shown) is inserted in a threaded radially extending opening 37 to engage shaft 21 to fixedly connect the sleeve 34 to shaft 21 for simultaneous rotation therewith. A felt seal 38 interconnects the sleeve 34 with the housing member 25 to provide a seal against dirt and debris.

A hub 40 includes an outer hub member 41 joined to an annular taper lock member or bushing 42 through a taper lock connection 43 so that both the outer member 41 and inner member 42 positively rotate in unison. Following the placement of sleeve 34 against the abutment 33 of motor shaft 21, the hub 40 is axially positioned to surround shaft 21 and engage an opposite end 44 of sleeve 34. In such manner, the hub 40 is precisely axially aligned upon shaft 21 by the positive positioning provided by sleeve 34. A key slot 45 provided in inner hub member 42 is aligned with a key slot 46 provided by shaft 21 with a key or member (not shown) inserted therein to positively interconnect the shaft 21 to hub 40 for positive rotation in unison. A felt seal 47 engages hub 40 and is retained in position by appropriate housing members 48 to act as a barrier against dirt and debris.

An annular shaped plate 50 is connected through a series of bolts or studs 51 to an annular extension 52 of hub 40 via a series of circumferentially spaced openings 53. A plate like surface 54 radially extends from a first circumferential surface 55 surrounding a circular opening 49 and extends radially to an outer circumferential surface 66. A series of radially extending, circumferentially spaced grooves 56 are formed in face 54 of plate 50. Each groove is of a dovetail type configuration having a base surface 57 which is connected to a pair of oppositely spaced converging sidewalls 58 and 59 each terminating at parallel spaced sidewalls 60 and 61, respectively. Each groove 56 extends from a point 62 co-extensive with the inner edge 55 of plate 50 and to a point 63 spaced between the inner edge 55 and the outer edge 66 of plate member 50. An abutment 64 is located adjacent to point 63 and includes a circumferential surface 65.

A series of particulate throwing blades 70 are circumferentially spaced by attachment to the plate 50. Specifically, each blade 70 is designed to be engaged within a corresponding groove 56 so as to be maintained in a radially and circumferentially spaced position. The blade 70 includes a particulate throwing web 71 having a pair of oppositely disposed sides 72 and 73 which extend longitudinally from a first blade end 74, to be located adjacent to point 62 of the inner surface 55 of plate 50, to a second blade end 75, which is designed to extend substantially beyond the outer plate edge 66. The web surfaces 72 and 73 are spaced by a first distance 76 at end 74 and a second distance 77 at end 75 so as to provide an inwardly directed taper to the web 71.

The blade 70 includes a pair of oppositely spaced side portions 78 and 79 which are connected substantially along the longitudinal extent of the side edges of web 71 and extend between the blade ends 74 and 75. Each of the side portions 78 and 79 extend outwardly from the web surfaces 72 and 73 to form oppositely directed sidewalls 80 and 81 to thereby define a pair of oppositely spaced particulate throwing channels 82 and 83, respectively.

A blade securing portion 85 is integrally connected to the side portion 79 and is specially constructed for removable attachment within one of the grooves 56 provided by plate 50.

The blade retention portion 85 includes a dovetail projection 86 including a pair of diverging sidewalls 87 and 88 terminating at a base wall 89. The dovetail projection 86 extends from a first point 90 which is aligned with blade end 74 to a second point 91 which is located between blade ends 74 and 75 and is substantially spaced from blade end 75.

The base wall 89 of blade retention portion 85 includes a pair of spaced surface portions 92 and 93 of limited area which sandwich a substantial area formed by an intervening recess 94. Further, an additional pair of spaced surface areas 95 and 96 of limited area sandwich an intervening recess 97. A pair of spaced lips 98 and 99 are provided by surface areas 93 and 95, respectively, and are located adjacent to a pair of spaced slots 100 and 101 joined through a recessed wall 102.

A stop 103 is located adjacent to point 91 and includes a circumferential abutting surface 104 which is designed to matingly engage the plate abutment 64 to limit radial outward movement of the blade 70 when the blade retention portion 85 is located within the groove 56.

A pad 105, made of resilient material such as plastic or the like and may be commercially purchased from Dupont under the trademark "Delrin ®", is connected to the blade retention portion 85. Specifically, the resilient pad 105 provides a first side 106 which engages the recessed wall 102 and includes a pair of spaced side edges 107 and 108 which are located within the slots 100 and 101 to be secured therein by the engaging lips 98 and 99, respectively. A second side 109 resiliently extends slightly outward from the plane of surfaces 92, 93, 95 and 96 to provide a frictional surface for releasable engagement with the base surface 57 of groove 56.

A center plate 112 is located adjacent to the end 35 of shaft 21 and includes an annular surface 113 which abuts against hub 40. An oppositely disposed annular surface 114 of centering plate 112 engages a hollow vaned impeller 115 having an axial opening to receive particular material from the feed spout 12. The impeller 115 includes a series of circumferentially spaced windows 116 for radially distributing the particulate material. A threaded bolt 117 provides a head 118 which engages a wall 119 of impeller 115 through a thrust washer 120 and provides outer threads 121 which are secured within a threaded opening 122 within end 35 of shaft 21. A fixed control cage 123 is connected to the housing 17 and maintained in a stationary position through a clamp 124 and feed spout 12. The cage 123 provides a circular housing having an output port 125 to direct particulate matter from the impeller 115 to the series of rotatable blades 70.

A housing cover assembly 130 forms a part of housing 17 and may be removed through the disengagement of one or more nuts 131. The removal of cover assembly 130 permits external access into a cavity 132 containing the blades 70 through an opening 133 at the upper portion of the housing 17.

In assembly, the sleeve 34 is mounted on the shaft 21 and moved in an axial direction until the sleeve and 36 engages the shaft abutment 33. When in place, the sleeve 34 is secured to shaft 21 by a set screw (not shown). Thereafter, the hub 40 is mounted on shaft 21 and moved in an axial direction until firmly abutting against the opposite end 44 of sleeve 34. The plate 50 is secured to hub 40 by the series of circumferentially spaced bolts or lugs 51 for positive rotation in unison with the output shaft 21.

Each blade 70 may be manually gripped at end 75 and inserted through opening 133 into cavity 132. The blade 70 is moved radially inward until blade end 74 is located within the opening 49 of plate 50 and at a point where the dovetail projection 86 of the blade retention portion 85 is permitted to enter the dovetail groove 56 at point 62. With the dovetail projection 86 slidingly engaging the dovetail groove 56, an operator by grasping end 75 may apply outwardly directed radial force to slide the blade retention portion 85 radially outward into the dovetail groove 56 until the abutting surface 104 of stop 103 engages the circumferential surface 65 of abutment 64 to terminate further radial outward movement. With the dovetail projection 86 fully within the dovetail groove 56, the outer surface 109 of pad 105 frictionally engages the wall 57 of groove 56 to maintain blade 70 in position relative to the plate 50 to prevent downward movement of blade 70 due to gravity.

After all of the blades 70 have been inserted into appropriate grooves 56, the centering plate 112 is positioned to abut the hub 40. The control cage 115 is thereafter connected to housing 17 to be spaced from the centering plate 112. The impeller 115 together with the securing bolt 118 and associated thrust washer 120 are assembled so that bolt 118 is secured within the threaded opening 122 provided by shaft 21. The tightening of bolt 118 provides a compressive force through the impeller 115 and control plate 112 to provide an axially directed thrust upon the hub 40. Axial movement of the hub 40, however, is restrained by the end 44 of sleeve 34. In such manner, the hub 40 and interconnected plate 50 and removably attached blades 70 are accurately aligned along the axial direction of shaft 21. The spacer 34 also provides the precise alignment of the centering plate 112 and impeller 115 along the axial direction of shaft 21. In that shaft 21 and interconnected hub 40, plate 50, blades 70, centering plate 112 and impeller 115 rotate at high velocity, it is important to have accurate alignment along the axial direction of shaft 21 to prevent interference with the control cage 123 or other stationary members such as housing 17.

A worn out blade 70 may be readily replaced from a radially outward position. For example, the spout 12, impeller 115, control cage 123 and centering plate 112 is removed by the disengagement of the securing pin 118 from the threaded opening 122 of shaft 21. Thereafter, the upper housing portion 130 is removed by the removal of one or more nuts 131. An operator removes the blade 70 by grasping the outer end 75 and pushing the blade 70 radially inward so that end 74 becomes positioned within the central opening 49 of plate 50. The radially inward movement proceeds only to a limited extent until the dovetail projection 86 clears the dovetail groove 56. When the dovetail projection 86 clears the dovetail groove 56, the blade 70 is moved slightly away from shaft 21 and the entire blade 70 is withdrawn through opening 133 to be replaced by a new blade.

The radially inward movement of blade 70 is greatly fascilitated by the reduced surface areas 92, 93, 95 and 96 which permit limited frictional resistance by the base surface 57 of groove 56. Such contruction with the reduced areas 92, 93, 95 and 96 is particularly useful for ready removal of a blade in cases where particulate matter becomes wedged between the blade 70 and plate 50.

The use of a blade retention portion 85 along only a limited extent of the total overall length of blade 70 permits the ready insertion of a substantially long blade by manual manipulation from a radially outward position. Such removable connection is maintained without the use of pins or spacers which , in prior constructions, have been subjected to extreme wear requiring frequent replacements therefore. Each of the blades 70 is supported and rotated by the use of only a single plate 50 engaging only one side of each blade 70. Some prior constructions have found it necessary to employ plates on both sides of each blade 70 which, in some situations, causes greater problems in replacing worn out blades 70.

The pad 105 provides the necessary friction to maintain the blade 70 in a radially outward position after being inserted within a groove 56. In other words, it is unnecessary for an operator to insert a hand within the central opening 49 of plate 50 to hold the blade 70 in position while being secured either by spacers or by a centering plate. In this regard, it is noted that the centering plate 112 is not needed to retain the blade 70 in an outward position, but rather functions as a backup safety feature in the unlikely event that a blade 70 would move in a radially inward direction.

The independent support of the motor 15 by the direct connection of the motor housing 16 to the blast wheel housing 17 eliminates the requirement of providing expensive supporting structure for the motor 15. Further, the mating of the annular machined surface 19 of the motor housing plate 18 with the annular machined surface 28 of the blast wheel housing 17 together with the engagement of the annular lips or abutments 20 and 29 establishes precise alignment of the rotor shaft 21 with respect to the housing 17. In such manner, the interconnected components, such as spacer 34, hub 40, centering plate 112, impeller 115, plate 50 and blades 70 become precisely aligned in the radial direction to avoid interference with the control cage 123 or other stationary members such as housing 17 without requiring complicated and expensive supporting structure for the positioning and alignment of the motor 15.

The centrifugal blasting apparatus 11 provides a highly desirable construction which furnishes distinct advantages in assembly and alignment of the elements while further permitting the easy replacement of worn parts.

Various modes of carrying out the invention are contemplated as being within the scope of the following claims particularly pointing out and distinctly claiming the subject matter which is regarded as the invention.

I claim:

1. A centrifugal apparatus, comprising a motor driven shaft providing an annular ridge spaced from the end of said shaft, a hub journalled on said shaft and connected to rotate with said shaft, a particulate throwing wheel operatively connected to said hub for rotation therewith, a hollow vaned impeller connected to said shaft by a threaded bolt and connected to said hub through a centering plate with said centering plate applying an axial force to said hub through said impeller in response to compression provided by said threaded bolt, a blast wheel housing surrounding said throwing wheel and said impeller, a stationary control cage fixedly attached to said blast wheel housing and located between said impeller and said throwing wheel, and an annular sleeve journalled on said shaft between said hub and said ridge and having a first axial end abutting said annular ridge and a second axial end abutting said hub to maintain said hub and interconnected impeller and throwing wheel in precise axially spaced alignment with respect to said annular ridge, means for fixedly connecting said sleeve to said shaft for simultaneous rotation of said sleeve and said shaft.

* * * * *